United States Patent [19]

Lebsock

[11] Patent Number: 4,990,889

[45] Date of Patent: Feb. 5, 1991

[54] FLARE SIMULATOR AND TEST CIRCUIT

[75] Inventor: Robert A. Lebsock, Las Cruces, N. Mex.

[73] Assignee: The United States of America as represented by the Secretary of the Army, Washington, D.C.

[21] Appl. No.: 351,112

[22] Filed: May 10, 1989

[51] Int. Cl.[5] ..... G08B 29/00

[52] U.S. Cl. ..... 340/515; 73/866.4; 192/206

[58] Field of Search ..... 73/167, 35, 865.6; 361/167, 168.1; 102/206; 340/635, 515, 817.19

[56] References Cited

U.S. PATENT DOCUMENTS

| | | | |
|---|---|---|---|
| 3,452,350 | 6/1969 | Rockwell | 340/515 X |
| 3,892,182 | 7/1975 | Covarrubias et al. | 361/251 X |
| 3,960,000 | 6/1976 | Barnett et al. | 73/167 X |
| 3,975,942 | 8/1976 | Dreitzler | 73/167 X |
| 4,755,693 | 7/1988 | Suzuki et al. | 307/308 X |
| 4,774,623 | 9/1988 | Gilman | 361/168.1 X |
| 4,776,277 | 10/1988 | Fiedler et al. | 73/167 X |
| 4,827,844 | 5/1989 | Miller | 102/206 X |
| 4,829,899 | 5/1989 | Wiker et al. | 102/206 |
| 4,832,900 | 5/1989 | Harbaugh | 73/865.6 X |

*Primary Examiner*—Daniel M. Yasich

*Attorney, Agent, or Firm*—Saul Elbaum; Guy M. Miller

[57] ABSTRACT

A squib simulator and dispensing equipment tester has a threshold circuit and simulated load connected to a double-pole magnetically latching relay that switches contacts and turns on a test indicator lamp when the dispensing equipment delivers an input pulse of sufficient amplitude and duration. A power supply provides a logic level through a feedback circuit and the latching relay to the dispensing equipment indicating the status of the squib as either fired or faulted. A reset switch also uses the power supply to reset the latching relay for additional tests.

6 Claims, 1 Drawing Sheet

FLARE SIMULATOR AND TEST CIRCUIT

RIGHTS OF THE GOVERNMENT

The invention described herein may be manufactured, used and licensed by or for the United states Government of Governmental purposes without payment to me of any royalty thereon.

BACKGROUND OF THE INVENTION

1. Field of the Invention

The present invention relates to simulators and tester circuits and, more particularly, is directed towards a novel flare or squib simulator and tester circuit that comprises a magnetically latching relay for recording positive test results of dispensing equipment.

2. Description of the Prior Art

Dispensing equipment used to fire flares or squibs has heretofore been difficult to evaluate. For example, certain types of flares are used for the countermeasures evaluation of electro-optic guided missile systems. Full and subscale aircraft targets are equipped with flare dispensing hardware and flares and then flown in a controlled test for the purpose of evaluating missile system performance. The flares are activated in accordance with the test requirements. In the past, when dispensing equipment of this type has required testing, actual flares or squibs have been used to test the equipment. Since each flare or squib has an explosive charge, testing is difficult. In particular, an intermittent problem associated with the dispensing equipment could result in an expensive and somewhat hazardous situation.

Currently, there is no method that exists to test the operation of flare dispensing equipment to the same level of reliability as can be accomplished using actual flares or squibs.

SUMMARY OF THE INVENTION

It is therefore a primary object of the invention to provide a dispensing equipment tester that can evaluate flare or squib type dispensing equipment without the need to use actual explosive devices.

It is further object of the invention to provide a dispensing equipment tester that simulates the presence of an actual flare or squib to the dispensing equipment being tested It is still a further object of the invention to provide a dispensing equipment tester and squib simulator that retains its data for evaluation and is reusable.

It is still a further object of the invention to provide a dispensing equipment tester and squib simulator that signals the dispensing equipment the status of the tester as either fired or faulted.

The foregoing and other objects are attained in accordance with the invention through the use of a device that comprises a double-pole magnetically latching relay having dual coils and first and second pole assemblies. A load is provided in shunt across the inputs of the device to simulate the presence of an actual flare or squib and is also connected through a path provided by the first pole assembly for feedback purposes. A threshold circuit determines when an input pulse generated by the dispensing equipment is of a sufficient amplitude and duration to energize a first coil in the latching relay. Upon energizing the first coil, the second pole assembly within the relay changes contact positions so as to turn on an indicator light. This represents proper operation of the dispensing equipment. The first pole assembly also changes contacts and provides a feedback path through the load to the dispensing equipment for simulating the flare or squib status as being fired or faulted. The relay magnetically latches to this position until power is supplied to energize a second coil by a reset switch. Energizing the second coil returns the armatures within the pole assemblies to their original contact positions.

BRIEF DESCRIPTION OF THE DRAWINGS

The foregoing and other objects, aspects, uses and advantages of the present invention will be more fully appreciated as the same becomes better understood when considered in connection with the following detailed description of the present invention and in conjunction with the accompanying drawings, in which.

DESCRIPTION OF THE PREFERRED EMBODIMENTS

Figure 1:
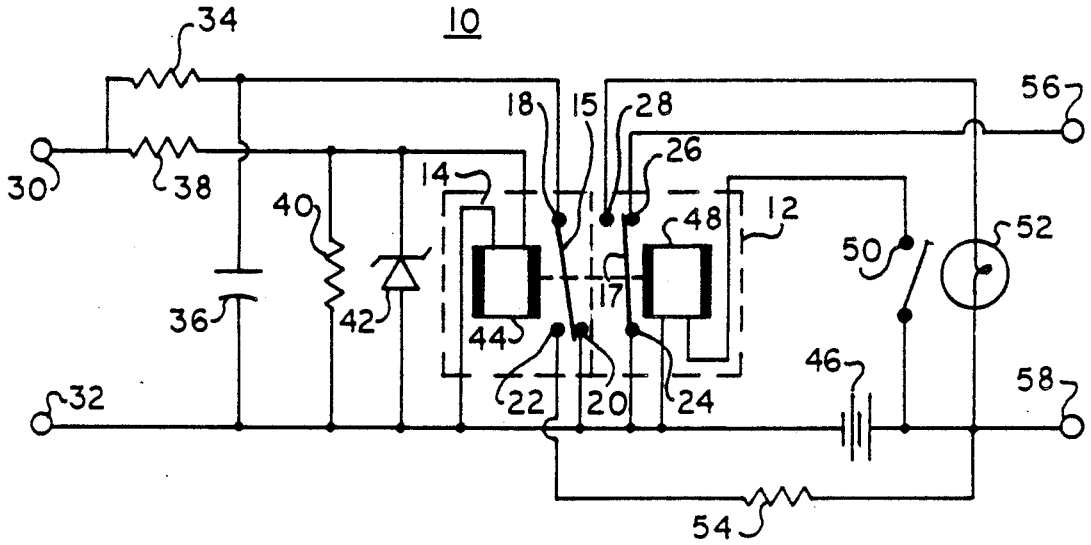
FIG. 1 shows a circuit schematic of a squib simulator and dispensing equipment tester acccording to an aspect of the invention.

FIG. 1 shows a flare or squib simulator and dispensing equipment tester 10. A double-pole magnetically latching relay 12 has a first single pole contact assembly 14 and a second single pole contact assembly 16. the first single pole contact assembly 14 has an armature 15, a common contact 18 and contacts 20 and 22. The second single pole contact assembly 16 has an armature 17, a common contact 24 and contacts 26 and 28. A simulated squib or load comprises resistor 34 with capacitor 36. One side of resistor 34 is connected to a first input terminal 30 while the other side is connected to one side of capacitor 36. The other side of capacitor 36 is connected to a second input terminal 32. The common connection between resistor 34 and capacitor 36 is connected to common contact 18. A threshold circuit comprises a first resistor 38 in series with a second resistor 40 and a zener diode 42 in parallel combination. The threshold circuit is connected in shunt across the first input terminal 30 and the second input terminal 32 in which one side of resistor 38 is connected to input terminal 30 while the other side is connected to one side of the parallel combination of resistor 40 and zener diode 42 and to one side of a first coil 44 within said latching relay 12. The other side of the parallel combination of resistor 40 and zener diode 42 is connected to the second input terminal 32 and to the other side of the first coil 44. A power source 46 with voltage V has one end connected to input terminal 32, contact 20, common contact 24 and one end of a second coil 48 while the other end is connected to one side of switch 50 and one side of indicator lamp 52. The other side of switch 50 is connected to the other side of the second coil 48 while the other side of indicator lamp 52 is connected to contact 28. A feedback resistor 54 has one side connected to the common connection of power source 46, switch 50 and indicator lamp 52 and another side connected to contact 22. Contact terminals 56 and 58 connected to contact 26 and to the other end of power source 46 respectfully provide test points to measure battery voltage.

The squid simulator and testing circuit 10 provides the dispensing equipment with a simulated flare or squib which tests the dispensing equipments ability to sucessfully activate (fire the squib) a real flare. The load comprising resistor 34 and capacitor 36 simulates the flare or squib. The dispensing equipment sends an input signal or fire pulse across the input terminals 30 and 32. The threshold circuit assesses the input pulse and energizes the latching relay 12 when the input pulse is of sufficient amplitude and duration. The latching relay 12 will respond when the input pulse is at least 24 to 28 volts d.c. and 10 msec in duration given the component value in the exemplary embodiment. The input pulse causes coil 44 to energize. Consequently, armature 17 in the second single pole contact assembly 16 breaks contact with contact 26 and makes contact with contact 28 while the armature 15 in the first single pole contact assembly 14 breaks contact with contact 20 and makes contact with contact 22. The completed circuit comprising the second single pole contact assembly 16, power supply 46 and indicator lamp 52 will cause the indicator lamp 52 to turn on indicating that the dispensing equipment is operating properly. Any lamp suitable for the power supply can be chosen. The double-pole latching relay 12 magnetically latches armatures 15 and 17 at their new positions on contacts 22 and 28 respectively thereby preserving the data obtained. Additionally, the making contact of armature 15 to contact 22 provides the power supply 46 with a current path back through feedback resistor 54 and resistor 34. This circuit provides a logic level across terminals 30 and 32 which may then be used by the dispensing equipment to indicate the flare status as either "fired" or "faulted."

After the dispensing equipment has been tested, switch 50 is closed providing power to the second coil 48. The energizing of coil 48 causes armatures 15 and 17 to return to their original positions. The relay 12 magnetically latches in this position resetting the relay 12 for further tests. In other words, the armature 15 in the first single pole contact assembly 14 breaks contact with contact 22 and makes contact with contact 20 while the armature 17 in the second single pole contact assembly 16 breaks contact from contact 26 and makes contact with contact 28.

A typical set of values for the components of the circuit of FIG. 1 is as follows:

| | | |
|---|---|---|
| Relay | 12 | DS2E-SL2-5v, Manf. AROMAT |
| Power Source V | 46 | 6 volts d.c., 4-AA batteries |
| Resistor | 34 | 10 ohms, 2 watt |
| Resistor | 38 | 1K ohms |
| Resistor | 40 | 2.2K ohms |
| Resistor | 54 | 330 ohms |
| Capacitor | 36 | 100 micro farads, 35 volts |
| Diode | 42 | IN4733, 5.1 volts |
| Lamp | 52 | ML/73, 14 volt |
| Switch | 50 | 881K11910, Manf. EATON |

Figure 2:
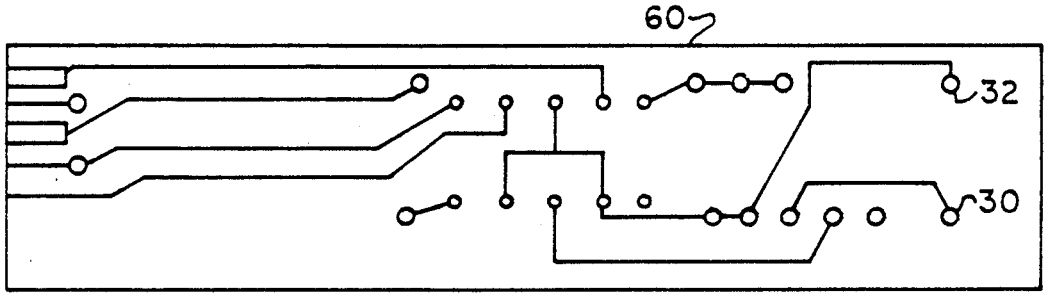
FIG. 2 shows a printed circuit board layout of the squib simulator and dispensing equipment tester of FIG. 1.

For ease of communication and connection with dispensing equipment existing expended flare and squib cases can be used to house the electronics. For example, FIG. 2 shows a long and thin printed circuit board 60 that can fit inside an expended M-206 flare case. Obviously, circuit boards with other dimensions, depending on the flare or squib, can be used to mount the electronics. An expended squib can be used to supply the electrical contacts required for communicating with the dispensing equipment.

Numerous modifications and variations of the present invention are possible in light of the above teachings. It is therefore to be understood that within the scope of the appended claims, the invention may be practiced otherwise than as specifically described herein.

What is claimed is:

1. A squib simulator and dispensing equipment tester comprising:

first and second input terminals for receiving an input pulse from said dispensing equipment;

a load connected in shunt across said first and second input terminals for simulating a squib;

a latching relay having a single pole contact assembly;

indicator means having one end connected to said single pole contact assembly;

a power source connected in series between another end of said indicator means and second input terminal;

a threshold circuit connected in shunt across said first and second input terminals, said threshold circuit connected to said latching relay that energizes said latching relay to switch contact positions when said input pulse is of sufficient amplitude and duration turning on said indicator means; and switch means connected to said power source and said latching relay for energizing said latching relay to switch contact positions upon closure of said switch means turning off said indicator means.

2. A squib simulator and dispensing equipment tester comprising:

first and second input terminals for receiving an input pulse from said dispensing equipment;

a load connected in shunt across said first and second input terminals for simulating a squib;

a double-pole latching relay having a first single pole contact assembly and a second single pole contact assembly, said first single pole contact assembly having a common contact connected to said load and said second single pole contact assembly having a common contact connected to said second input terminal;

indicator means having one end connected to a first contact position on said second single pole contact assembly;

a power source connected in series between another end of said indicator means and said second input terminal;

a threshold circuit connected in shunt across said first and second input terminals, said threshold circuit connected to said double-pole latching relay for energizing said double-pole latching relay and switching contact positions when said input pulse is of sufficient amplitude and duration turning on said indicator means;

a feedback circuit connected in series between said power source and said first single pole contact assembly for providing a current path through said load to said first input terminal upon the energizing of said double-pole latching relay by said input pulse; and switch means connected to said power source and said latching relay for energizing said latching relay to switch contact positions upon closure of said switch means turning off said indicator means.

3. The squib simulator and dispensing equipment tester of claim 2 wherein said load comprises:

capacitive means having one end connected to said second input terminal; and resistive means having one end connected to said first input terminal and another end connected to another end of said capacitive means and to said common contact of said first single pole contact assembly.

4. The squib simulator and dispensing equipment tester of claim 3 wherein said threshold circuit comprises:

a first resistor in series with a parallel combination of a second resistor and a zener diode.

5. The squib simulator and dispensing equipment tester of claim 4 wherein said indicating means comprises:

a lamp.

6. A squib simulator and dispensing equipment tester comprising:

first and second input terminals for receiving an input pulse from said dispensing equipment;

a load comprising capacitive means having one end connected to said second input terminal and first resistive means having one end connected to said first input terminal and another end connected to another end of said capacitive means for simulating a squib;

a double-pole magnetically latching relay having a first single pole contact assembly and a second single pole contact assembly, said first single pole contact assembly having a common contact. connected to said another end of said first resistive means and a second single pole contact assembly having a common contact connected to said second input terminal;

indicator means having one end connected to a first contact position on said second single pole contact assembly;

a power source connected in series between another end of said indicator means and said second input terminal;

a threshold circuit connected in shunt across said first and second input terminals comprising a second resistive means in series with a parallel combination of a third resistive means and a zener diode, said threshold circuit connected to said double-pole latching relay for energizing said double-pole latching relay and switching contact postions when said input pulse is of sufficient amplitude and duration turning on said indicator means;

a feedback circuit connected in series between said power source and said first single pole contact assembly for providing a current path through said load to said first input terminal when said input pulse switches said double-pole latching relay; and switch means connected to said power source and said latching relay for energizing said latching relay to switch contact positions upon closure of said switch means turning off said +indicator means.

* * * * *